US012806732B2

(12) United States Patent
Pollard et al.

(10) Patent No.: US 12,806,732 B2
(45) Date of Patent: Nov. 24, 2026

(54) STEAM GENERATION FOR CHEMICAL MECHANICAL POLISHING

(71) Applicant: Applied Materials, Inc., Santa Clara, CA (US)

(72) Inventors: Chad Pollard, San Jose, CA (US); Sih-Ling Yeh, Sunnyvale, CA (US); Jonathan P. Domin, Sunnyvale, CA (US); Shou-Sung Chang, Mountain View, CA (US); Haosheng Wu, San Jose, CA (US); Jeonghoon Oh, Saratoga, CA (US); Jianshe Tang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 400 days.

(21) Appl. No.: 18/632,044

(22) Filed: Apr. 10, 2024

(65) Prior Publication Data

US 2024/0342855 A1 Oct. 17, 2024

Related U.S. Application Data

(60) Provisional application No. 63/496,362, filed on Apr. 14, 2023.

(51) Int. Cl.
*B24B 37/015* (2012.01)
*B24B 37/04* (2012.01)
(Continued)

(52) U.S. Cl.
CPC ..... *B24B 37/015* (2013.01); *B24B 37/04* (2013.01); *B24B 37/042* (2013.01);
(Continued)

(58) Field of Classification Search
CPC ..... B24B 37/015; B24B 37/04; B24B 37/00; B24B 37/005; B24B 37/042;
(Continued)

(56) References Cited

U.S. PATENT DOCUMENTS 4,605,838 A * 8/1986 Daney ..... F22B 1/284 392/401
5,058,194 A 10/1991 Violi
(Continued)

FOREIGN PATENT DOCUMENTS

DE 3532261 3/1987
JP H094804 A * 1/1997 ..... F22B 1/284
(Continued)

OTHER PUBLICATIONS

Office Action in Taiwanese Appln. No. 113113516, mailed on Mar. 25, 2025, 8 pages (with English summary).
(Continued)

*Primary Examiner* — Michael A Gump
(74) *Attorney, Agent, or Firm* — Fish & Richardson P.C.

(57) ABSTRACT

A chemical mechanical polishing system includes a platen to support a polishing pad, a carrier head to hold a substrate in contact with the polishing pad, a motor to generate relative motion, a steam generator, and an arm extending over the platen with and at least one opening to deliver steam from the steam generator onto the polishing pad. The steam generator includes a canister, a barrier in the canister dividing the canister into a lower chamber having a water inlet and an upper chamber having a steam outlet, a heating element configured to apply heat to a portion of lower chamber, and a nucleation surface positioned in the lower chamber. The barrier has apertures for steam to pass from the
(Continued)

lower chamber to the upper chamber and allows for condensation to pass from the upper chamber to the lower chamber.

11 Claims, 9 Drawing Sheets

(51) Int. Cl.
*B24B 37/34* (2012.01)
*B24B 57/02* (2006.01)

(52) U.S. Cl.
CPC ..... *B24B 37/044* (2013.01); *B24B 37/046* (2013.01); *B24B 37/34* (2013.01); *B24B 57/02* (2013.01)

(58) Field of Classification Search
CPC ..... B24B 37/044; B24B 37/34; B24B 37/046; B24B 37/345; B24B 49/105; B24B 49/10; B24B 49/14; B24B 53/017; B24B 55/06; B24B 7/228; B24B 7/04; B24B 57/02; F22B 1/285; F22B 1/28; F22B 1/284; F22D 5/28; B08B 2230/01; B08B 2230/00; B08B 2203/00
USPC ..... 451/285
See application file for complete search history.

(56) References Cited

U.S. PATENT DOCUMENTS

| | | | | |
|---|---|---|---|---|
| 5,467,424 | A | 11/1995 | Davies et al. | |
| 5,537,508 | A * | 7/1996 | Ebbing | B01D 1/305 392/399 |
| 5,709,593 | A | 1/1998 | Guthrie | |
| 5,722,875 | A | 3/1998 | Iwashita et al. | |
| 5,738,574 | A | 4/1998 | Tolles et al. | |
| 5,851,135 | A | 12/1998 | Sandhu et al. | |
| 5,873,769 | A | 2/1999 | Chiou et al. | |
| 5,957,750 | A | 9/1999 | Brunelli | |
| 6,000,997 | A | 12/1999 | Kao et al. | |
| 6,023,941 | A | 2/2000 | Rhoades | |
| 6,257,954 | B1 | 7/2001 | Ng et al. | |
| 6,257,955 | B1 | 7/2001 | Springer et al. | |
| 6,776,691 | B2 | 8/2004 | Nishimura et al. | |
| 9,005,999 | B2 | 4/2015 | Xu et al. | |
| 9,475,167 | B2 | 10/2016 | Maruyama et al. | |
| 9,782,870 | B2 | 10/2017 | Maruyama et al. | |
| 10,002,777 | B2 | 6/2018 | Kweon et al. | |
| 10,660,163 | B2 * | 5/2020 | Erisgen | F24F 6/025 |
| 11,446,711 | B2 | 9/2022 | Wu et al. | |
| 2003/0211816 | A1 | 11/2003 | Liu et al. | |
| 2010/0081360 | A1 | 4/2010 | Xu et al. | |
| 2010/0279435 | A1 | 11/2010 | Xu et al. | |
| 2011/0159782 | A1 | 6/2011 | Sone et al. | |
| 2012/0190273 | A1 | 7/2012 | Ono et al. | |
| 2013/0023186 | A1 | 1/2013 | Motoshima et al. | |
| 2014/0120725 | A1 | 5/2014 | Miyazaki et al. | |
| 2014/0323017 | A1 | 10/2014 | Tang et al. | |
| 2015/0224621 | A1 | 8/2015 | Motoshima et al. | |
| 2017/0232572 | A1 | 8/2017 | Brown | |
| 2019/0143476 | A1 | 5/2019 | Wu | |
| 2020/0001426 | A1 | 1/2020 | Soundararajan et al. | |
| 2020/0001427 | A1 | 1/2020 | Soundararajan et al. | |
| 2020/0262024 | A1 | 8/2020 | Chang et al. | |
| 2020/0376522 | A1 | 12/2020 | Wu et al. | |
| 2020/0376523 | A1 | 12/2020 | Wu et al. | |
| 2020/0376626 | A1 | 12/2020 | Wu et al. | |
| 2020/0406310 | A1 * | 12/2020 | Soundararajan | B08B 1/14 |
| 2022/0355440 | A1 | 11/2022 | Soundararajan et al. | |
| 2022/0388041 | A1 | 12/2022 | Wu et al. | |
| 2023/0249225 | A1 | 8/2023 | Wu et al. | |
| 2023/0256562 | A1 | 8/2023 | Wu et al. | |

FOREIGN PATENT DOCUMENTS

| | | |
|---|---|---|
| JP | 2007-035973 | 2/2007 |
| JP | 2015-042925 | 3/2015 |
| KR | 20-0241537 | 10/2001 |
| KR | 10-2006-0076332 | 7/2006 |
| KR | 10-1816694 | 1/2018 |
| KR | 10-2020-0056015 | 5/2020 |
| TW | 436916 | 5/2001 |
| TW | 202303736 A | 1/2023 |
| TW | 202314848 A | 4/2023 |
| WO | WO 1997/021057 | 6/1997 |
| WO | WO 2020/243305 A1 | 12/2020 |
| WO | WO 2022/235592 A1 | 11/2022 |

OTHER PUBLICATIONS

International Search Report and Written Opinion in International Appln. No. PCT/US2024/023904, mailed on Jul. 12, 2024, 10 pages.

* cited by examiner

STEAM GENERATION FOR CHEMICAL MECHANICAL POLISHING

CROSS-REFERENCE TO RELATED APPLICATIONS

This application claims the benefit of priority to U.S. Application No. 63/496,362, filed on Apr. 14, 2023, the contents of which are hereby incorporated by reference.

TECHNICAL FIELD

The present disclosure relates to the generation of steam for cleaning or preheating during chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

Steam has been proposed to be used for a variety of purposes in CMP systems, e.g., heating or cleaning of various components, such as the polishing pad, substrate, carrier head, or conditioning disk.

SUMMARY

In one aspect, a chemical mechanical polishing system includes a platen to support a polishing pad, a carrier head to hold a substrate in contact with the polishing pad, a motor to generate relative motion between the platen and the carrier head, a steam generator, and an arm extending over the platen with and at least opening to deliver steam from the steam generator onto the polishing pad. The steam generator includes a canister, a barrier in the canister dividing the canister into a lower chamber having a water inlet and an upper chamber having a steam outlet, a heating element configured to apply heat to a portion of lower chamber, and a nucleation surface positioned in the lower chamber. The barrier has apertures for steam to pass from the lower chamber to the upper chamber and allows for condensation to pass from the upper chamber to the lower chamber.

In another aspect, a steam generator apparatus includes a canister, a barrier in the canister dividing the canister into a lower chamber having a water inlet and an upper chamber having a steam outlet with the barrier having apertures for steam to pass from the lower chamber to the upper chamber and allowing for condensation to pass from the upper chamber to the lower chamber, a heating element configured to apply heat to a portion of lower chamber, and a wire that provides a nucleation surface and that extends from the lower chamber through one of the apertures in the barrier into the upper chamber.

Possible advantages may include, but are not limited to, one or more of the following.

Steam, i.e., gaseous $H_2O$ generated by boiling, can be generated in sufficient quantities with low levels of contaminants. Additionally, a steam generator can generate steam that is substantially pure gas, e.g., has little to no suspended liquid in the steam. Such steam, also known as dry steam, can provide a gaseous form of $H_2O$ that has a higher energy transfer and lower liquid content than other steam alternatives such as flash steam. Steam can be generated with reduced "bumping," and thus with lower likelihood of that water droplets will enter the gas flow and with a more uniform pressure over time. Water droplets that do escape the reservoir can be directed back to the reservoir, e.g., into a bypass channel, thus improving the "dryness" of the steam.

The substrate and/or one or more components of a CMP apparatus can be quickly and efficiently cleaned or preheated. Thus, defects on the substrate can be reduced and wafer-to-wafer uniformity can be improved.

The details of one or more implementations are set forth in the accompanying drawings and the description below. Other aspects, features, and advantages will be apparent from the description and drawings, and from the claims.

DETAILED DESCRIPTION

Steam, i.e., gaseous $H_2O$ generated by boiling, can be used to clean and/or pre-heat the substrate and/or one or more components of a CMP apparatus using. For preheating, by more tightly controlling the temperature of the substrate or system components, e.g., the polishing pad, variation in temperature can be reduced, and polishing performance, e.g., as measured by within-wafer non-uniformity or wafer-to-wafer non-uniformity, can be improved. A potential advantage of steam, as compared to hot water, is that less steam may be required to impart an equivalent amount of energy, e.g., due to the latent heat of the steam. For cleaning, steam can be more effective than liquid water in dissolving or otherwise removing polishing by-products.

A problem that can occur during generation of steam is "bumping," i.e., the water in the boiler canister can form bubbles that can cause the water to splash upwardly, potentially causing liquid water droplets to enter the gas stream that is directed to the CMP system. This results in a "wetter" steam, which can have a lower heat capacity. The bubbles can also result in large fluctuations of the pressure of the steam in the outlet line from the boiler. Bumping appears to be a particular problem for boilers having a smaller capacity or having a higher power density, e.g., greater than about 35 $W/in^3$.

A technique to address this is to introduce surfaces that provide increased nucleation. In particular, a metal wire can extend through the boiling canister and through an outlet and into a bypass channel. In addition to providing a nucleation surface, water droplets that escape the canister can be trapped on the wire and flow back into the reservoir.

Figure 1:
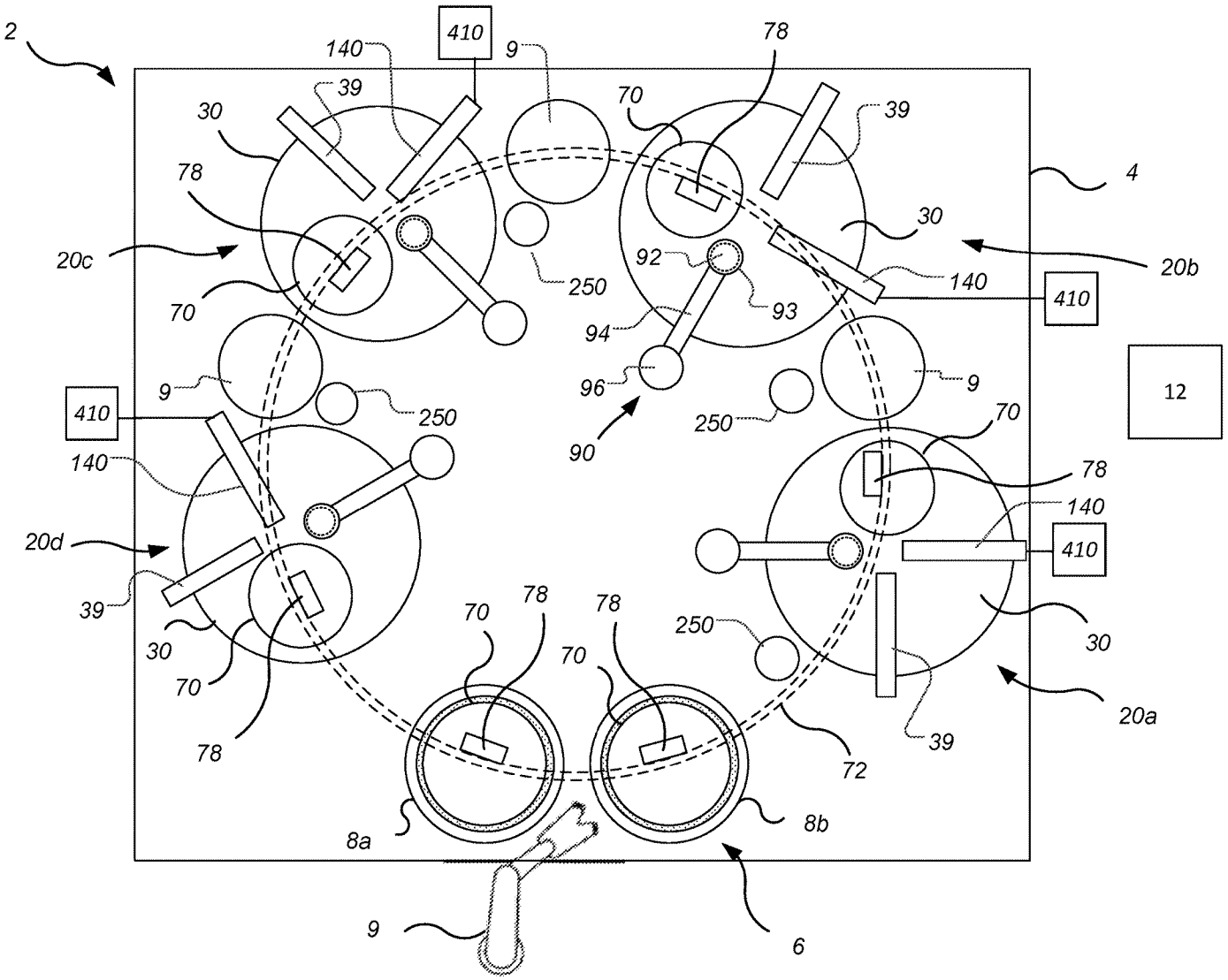
FIG. 1 is a schematic plan view of an example of a polishing apparatus.

FIG. 1 is a plan view of a chemical mechanical polishing apparatus 2 for processing one or more substrates. The polishing apparatus 2 includes a polishing platform 4 that at least partially supports and houses one or more polishing stations 20 to polish a substrate that is retained in a carrier head 70. For example, the polishing apparatus can include four polishing stations 20*a*, 20*b*, 20*c* and 20*d*.

The polishing apparatus 2 also includes a multiplicity of carrier heads 70, each of which is configured to carry a substrate. The polishing apparatus 2 also includes a transfer station 6 for loading and unloading substrates from the carrier heads. The transfer station 6 can include a one or more load cups 8, e.g., two load cups 8*a*, 8*b*, adapted to facilitate transfer of a substrate between the carrier heads 70 and a factory interface (not shown) or other device (not shown) by a transfer robot 9.

For a polishing operation, one carrier head 70 can be positioned at each polishing station. Two additional carrier heads can be positioned in the loading and unloading station 6 to exchange polished substrates for unpolished substrates while the other substrates are being polished at the polishing stations 20.

The carrier heads 70 are held by a support structure that can cause each carrier head to move along a path that passes, in order, the first polishing station 20*a*, the second polishing station 20*b*, the third polishing station 20*c*, and the fourth polishing station 20*d*. This permits each carrier head to be selectively positioned over the polishing stations 20 and the load cups 8.

In some implementations, each carrier head 70 is coupled to a carriage 78 that is mounted to a support structure 72. By moving a carriage 78 along the support structure 72, e.g., a track, the carrier head 70 can be positioned over a selected polishing station 20 or load cup 8. Alternatively, the carrier heads 70 can be suspended from a carousel, and rotation of the carousel moves all of the carrier heads simultaneously along a circular path.

Each polishing station 20 of the polishing apparatus 2 can include a port, e.g., at the end of a slurry supply arm 39, to dispense polishing liquid 38 (see FIG. 2A), such as abrasive slurry, onto the polishing pad 30. Each polishing station 20 of the polishing apparatus 2 can also include pad conditioner 93 to abrade the polishing pad 30 to maintain the polishing pad 30 in a consistent abrasive state.

In addition, each polishing station 20 can include a heating system 104 that has an arm 140 that extends over the platen 24 to provide steam onto the polishing pad.

Figure 2A:
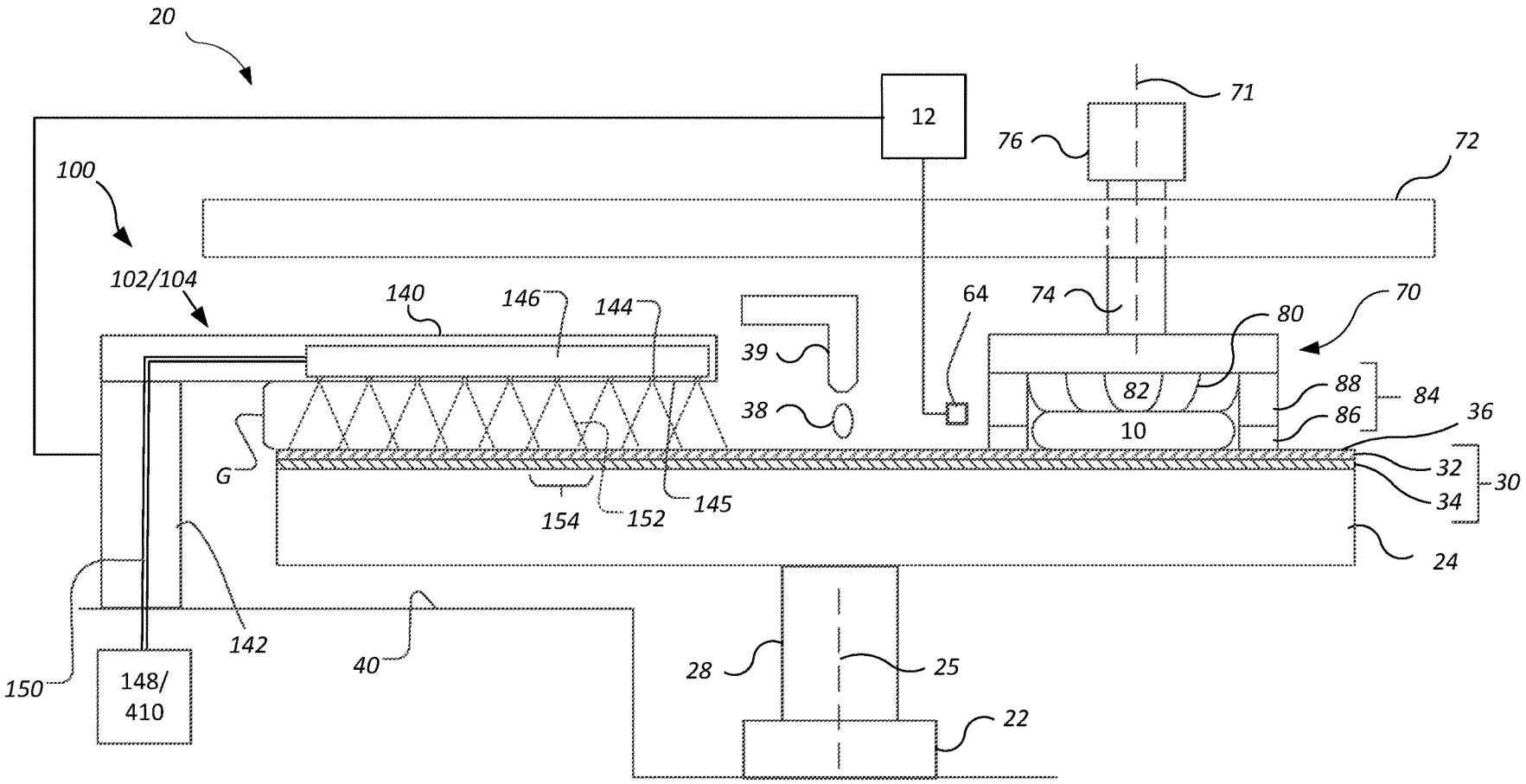
FIG. 2A is a schematic cross-sectional view of an example of a polishing station of the polishing apparatus.
Figure 2B:
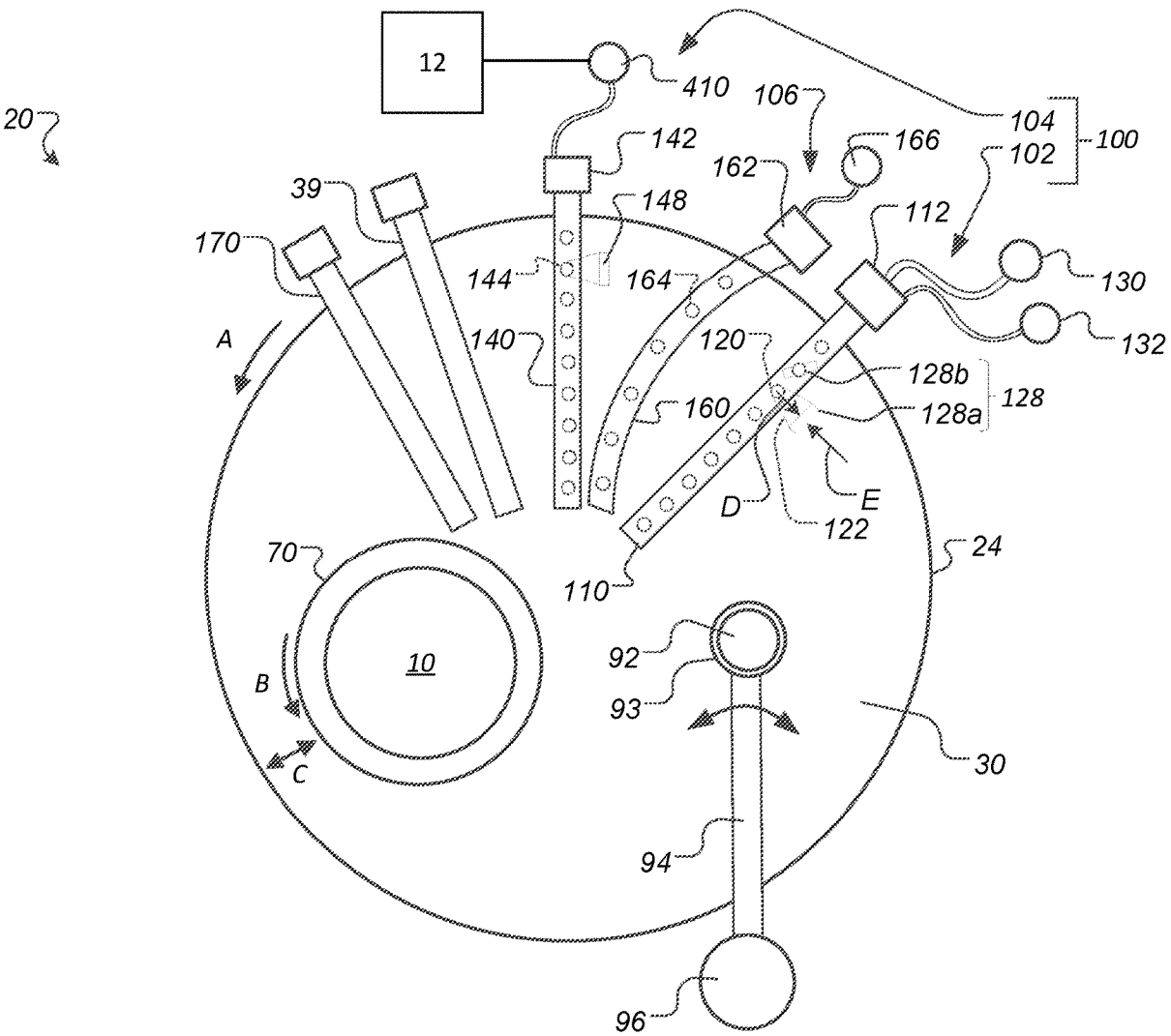
FIG. 2B is a schematic top view of an example polishing station of the chemical mechanical polishing apparatus.

FIGS. 2A and 2B illustrate an example of a polishing station 20 of a chemical mechanical polishing system. The polishing station 20 includes a rotatable disk-shaped platen 24 on which a polishing pad 30 is situated. The platen 24 is operable to rotate (see arrow A in FIG. 2B) about an axis 25. For example, a motor 22 can turn a drive shaft 28 to rotate the platen 24. The polishing pad 30 can be a two-layer polishing pad with an outer polishing layer 34 and a softer backing layer 32.

Referring to FIGS. 1, 2A and 2B, the polishing station 20 can include a supply port, e.g., at the end of a slurry supply arm 39, to dispense a polishing liquid 38, such as an abrasive slurry, onto the polishing pad 30.

The polishing station 20 can include a pad conditioner 90 with a conditioner disk 92 (see FIG. 2B) to maintain the surface roughness of the polishing pad 30. The conditioner disk 92 can be positioned in a conditioner head 93 at the end of an arm 94. The arm 94 and conditioner head 93 are supported by a base 96. The arm 94 can swing so as to sweep the conditioner head 93 and conditioner disk 92 laterally across the polishing pad 30. A cleaning cup 250 can be located adjacent the platen 24 at a position to which the arm 94 can move the conditioner head 93.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel, by movement along the track, or by rotational oscillation of the carousel itself.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head 70 can include a retaining ring 84 to hold the substrate. In some implementations, the retaining ring 84 may include a lower plastic portion 86 that contacts the polishing pad, and an upper portion 88 of a harder material, e.g., a metal.

In operation, the platen is rotated about its central axis 25, and the carrier head is rotated about its central axis 71 (see arrow B in FIG. 2B) and translated laterally (see arrow C in FIG. 2B) across the top surface of the polishing pad 30.

Referring to FIGS. 2A and 2B, as the carrier head 70 sweeps across the polishing pad 30, any exposed surfaces of the carrier head 70 tend to become covered with slurry. For example, slurry can stick to the outer or inner diameter surface of the retaining ring 84. In general, for any surfaces that are not maintained in a wet condition, the slurry will tend to coagulate and/or dry out. As a result, particulates can form on the carrier head 70. If these particulates become dislodged, the particulates can scratch the substrate, resulting in polishing defects.

Moreover, the slurry can cake onto the carrier head 70, or the sodium hydroxide in the slurry can crystallize on one of the surfaces of the carrier head 70 and/or the substrate 10 and cause the surface of the carrier head 70 to be corrode. The caked-on slurry is difficult to remove and the crystallized sodium hydroxide is difficult to return to a solution.

Similar problems occur with the conditioner head 92, e.g., particulates can form on the conditioner head 92, the slurry can cake onto the conditioner head 92, or the sodium hydroxide in the slurry can crystallize on one of the surfaces of the conditioner head 92.

One solution is to clean the components, e.g., the carrier head 70 and conditioner head 92, with a liquid water jet. However, the components can be difficult to clean with a water jet alone, and a substantial amount of water may be necessary. Additionally, the components that contact the polishing pad 30, e.g., the carrier head 70, substrate 10 and conditioner disk 92, can act as heat sinks that hinder uniformity of the polishing pad temperature.

Figure 3A:
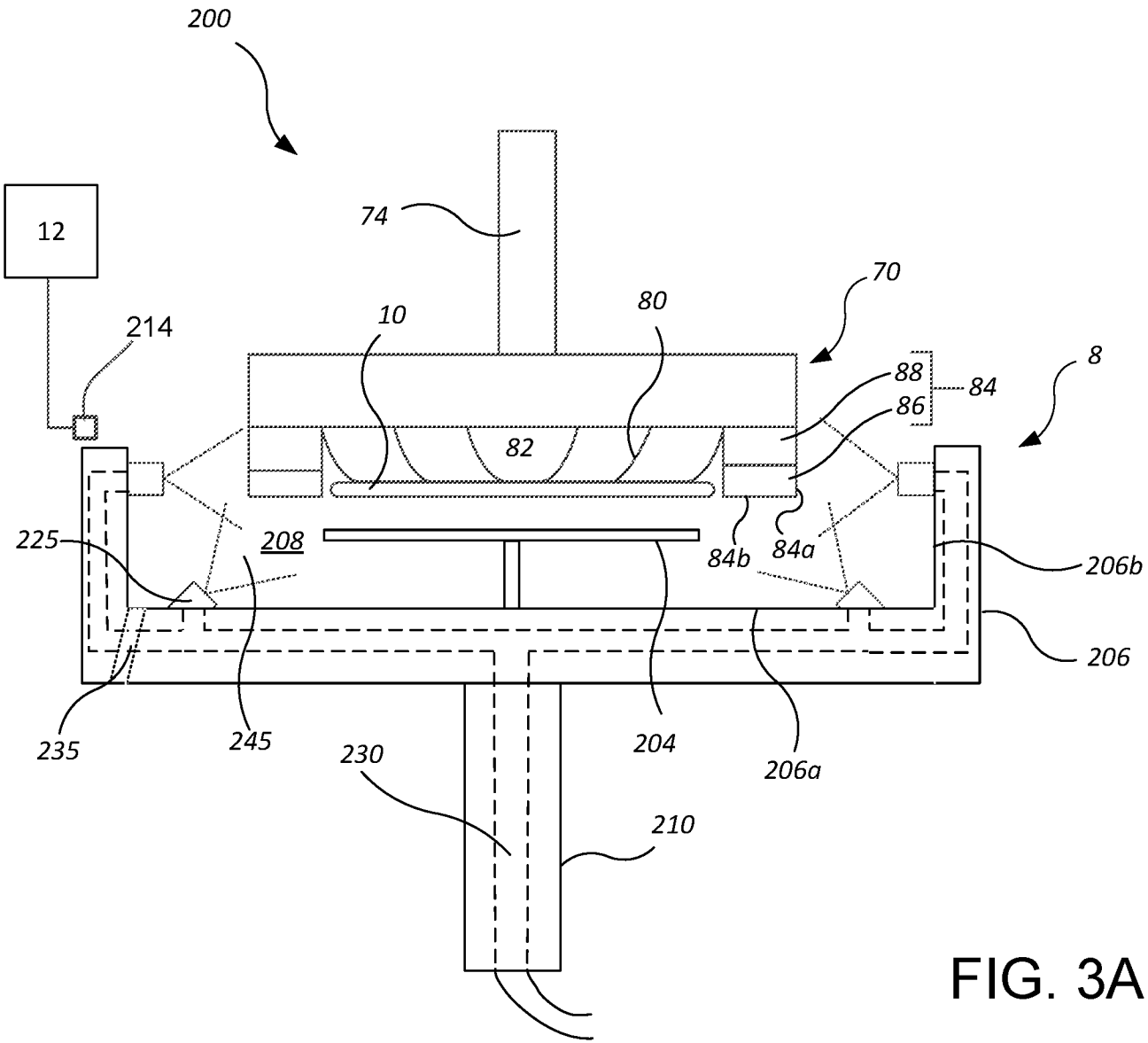
FIG. 3A is a schematic cross-sectional view of an example carrier head steam treating assembly.

To address these problems, as shown in the FIG. 3A, the polishing apparatus 2 includes one or more carrier head steam treating assemblies 200. Each steam treating assembly 200 can be used for cleaning and/or pre-heating of the carrier head 70 and substrate 10.

A steam treating assembly 200 can be part of the load cup 8, e.g., part of the load cup 8*a* or 8*b*. Alternatively or in addition, a steam treating assembly 200 can be provided at one or more inter-platen stations 9 located between adjacent polishing stations 20.

The load cup 8 includes a pedestal 204 to hold the substrate 10 during a loading/unloading process. The load cup 8 also includes a housing 206 that surrounds or substantially surrounds the pedestal 204. Multiple nozzles 225 are supported by the housing 206 or a separate support to deliver steam 245 to a carrier head and/or substrate positioned in a cavity 208 defined by the housing 206. For example, nozzles 225 can be positioned on one or more interior surfaces of the housing 206, e.g., a floor 206*a* and/or a side wall 206*b* and/or a ceiling of the cavity. The nozzles 225 can be oriented to direct steam inwardly into the cavity 208. The steam 245 can be generated by using the steam generator 410, e.g., a steam generator discussed further below. A drain 235 can permit excess water, cleaning solution, and cleaning by-product to pass through to prevent accumulation in the load cup 8.

An actuator provides relative vertical motion between the housing 206 and the carrier head 70. For example, a shaft 210 can support the housing 206 and be vertically actuatable to raise and lower the housing 206. Alternatively, the carrier head 70 can move vertically. The pedestal 205 can be on-axis with the shaft 210. The pedestal 204 can be vertically movable relative to the housing 206.

In operation, the carrier head 70 can be positioned over the load cup 8, and the housing 206 can be raised (or the carrier head 70 lowered) so that the carrier head 70 is partially within the cavity 208. A substrate 10 can begin on the pedestal 204 and be chucked onto the carrier head 70, and/or begin on the carrier head 70 and be dechucked onto the pedestal 204.

Steam is directed through the nozzles 225 to clean and/or preheat one or more surfaces of the substrate 10 and/or carrier head 70. For example, one or more of the nozzles can be positioned to direct steam onto the outer surface of the carrier head 70, the outer surface 84*a* of the retaining ring 84, and/or the bottom surface 84*b* of the retaining ring 84. One or more of the nozzles can be positioned to direct steam onto a front surface of a substrate 10 being held by the carrier head 70, i.e., the surface to be polished, or onto the bottom surface of the membrane 80 if no substrate 10 is being supported on the carrier head 70. One or more nozzles can be positioned below the pedestal 204 to direct steam upward onto the front surface of a substrate 10 positioned on pedestal 204. One or more nozzles can be positioned above the pedestal 204 to direct steam downward onto a back surface of a substrate 10 positioned on pedestal 204. The carrier head 70 can rotate within the load cup 8 and/or move vertically relative to the load cup 8 to allow the nozzles 225 to treat different areas of the carrier head 70 and/or substrate 10. The substrate 10 can rest on the pedestal 204 to allow for the interior surfaces of the carrier head 70 to be steam treated, e.g., the bottom surface of the membrane 82, or the inner surfaces of the retaining ring 84.

Steam is circulated from a steam source through a supply line 230 through the housing 206 to the nozzles 225. The nozzles 225 can spray steam 245 to remove organic residues, by-product, debris, and slurry particles left on the carrier head 70 and the substrate 10 after each polishing operation. The nozzles 225 can spray steam 245 to heat the substrate 10 and/or carrier head 70.

An inter-platen station 9 can be constructed and operated similarly, but need not have a substrate support pedestal.

The steam 245 delivered by the nozzles 225 can have an adjustable temperature, pressure, and flow rate to vary the cleaning and preheating of the carrier head 70 and the substrate 10. In some implementations, the temperature, pressure and/or flow rate can be independently adjustable for each nozzle or between groups of nozzles.

Figure 4A:
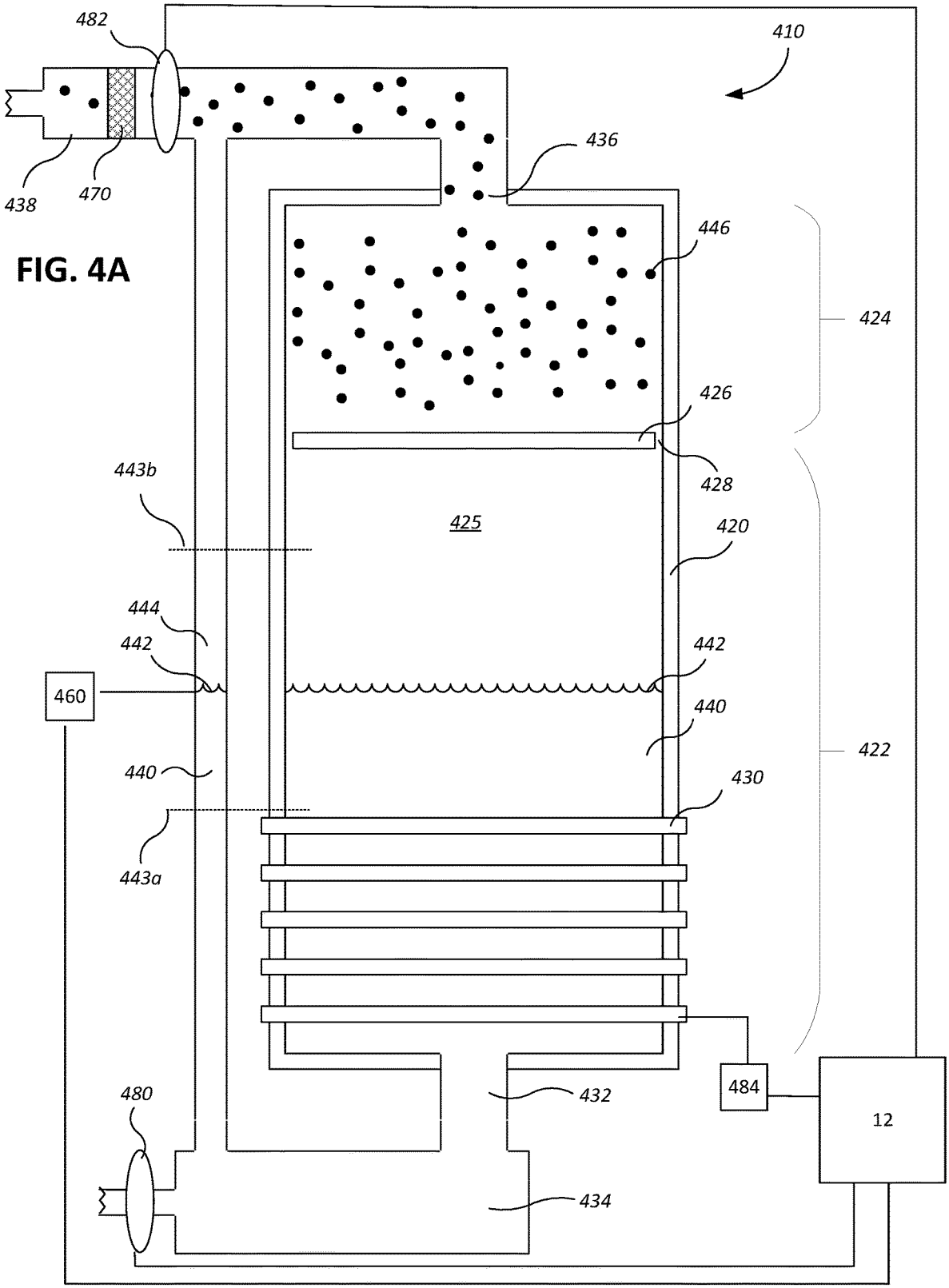
FIG. 4A is a schematic cross-sectional view of an example steam generator.

For example, the temperature of the steam 245 can be 90 to 200° C. when the steam 245 is generated (e.g., in the steam generator 410 in FIG. 4A). The temperature of the steam 245 can be between 90 to 150° C. when the steam 245 is dispensed by the nozzles 225, e.g., due to heat loss in transit. In some implementations, steam is delivered by the nozzles 225 at a temperature of 70-100° C., e.g., 80-90° C. In some implementations, the steam delivered by the nozzles is superheated, i.e., is at a temperature above the boiling point.

The flow rate of the steam 245 can be 1-1000 cc/minute when the steam 245 is delivered by the nozzles 225, depending on heater power and pressure. In some implementations, the steam is mixed with other gases, e.g., is mixed with normal atmosphere or with $N_2$. Alternatively, the fluid delivered by the nozzles 225 is substantially purely water. In some implementations, the steam 245 delivered by the nozzles 225 is mixed with liquid water, e.g., aerosolized water. For example, liquid water and steam can be combined at a relative flow ratio (e.g., with flow rates in sccm) 1:1 to 1:10. However, if the amount of liquid water is low, e.g., less than 5 wt %, e.g., less than 3 wt %, e.g., less than 1 wt %, then the steam will have superior heat transfer qualities. Thus, in some implementations the steam is dry steam, i.e., is substantially free of water droplets.

To avoid degrading the membrane with heat, water can be mixed with the steam 245 to reduce the temperature, e.g., to around 40-50° C. The temperature of the steam 245 can be reduced by mixing cooled water into the steam 245, or mixing water at the same or substantially the same temperature into the steam 245 (as liquid water transfers less energy than gaseous water).

In some implementations, a temperature sensor 214 can be installed in or adjacent the steam treating assembly 200 to detect the temperature of the carrier head 70 and/or the substrate 10. A signal from the sensor 214 can be received by a controller 12 to monitor the temperature of the carrier head 70 and/or the substrate 10. The controller 12 can control delivery of the steam by the assembly 100 based on the temperature measurement from the temperature sensor 214. For example, the controller can receive a target temperature value. If the controller 12 detects that the temperature measurement exceeds a target value, the controller 12 halt the flow of steam. As another example, the controller 12 can reduce the steam delivery flow rate and/or reduce the steam temperature, e.g., to prevent overheating of the components during cleaning and/or preheating.

In some implementations, the controller 12 includes a timer. In this case, the controller 12 can start when delivery of the steam begins, and can halt delivery of steam upon expiration of the timer. The timer can be set based on empirical testing to attain a desired temperature of the carrier head 70 and substrate 10 during cleaning and/or preheating.

Figure 3B:
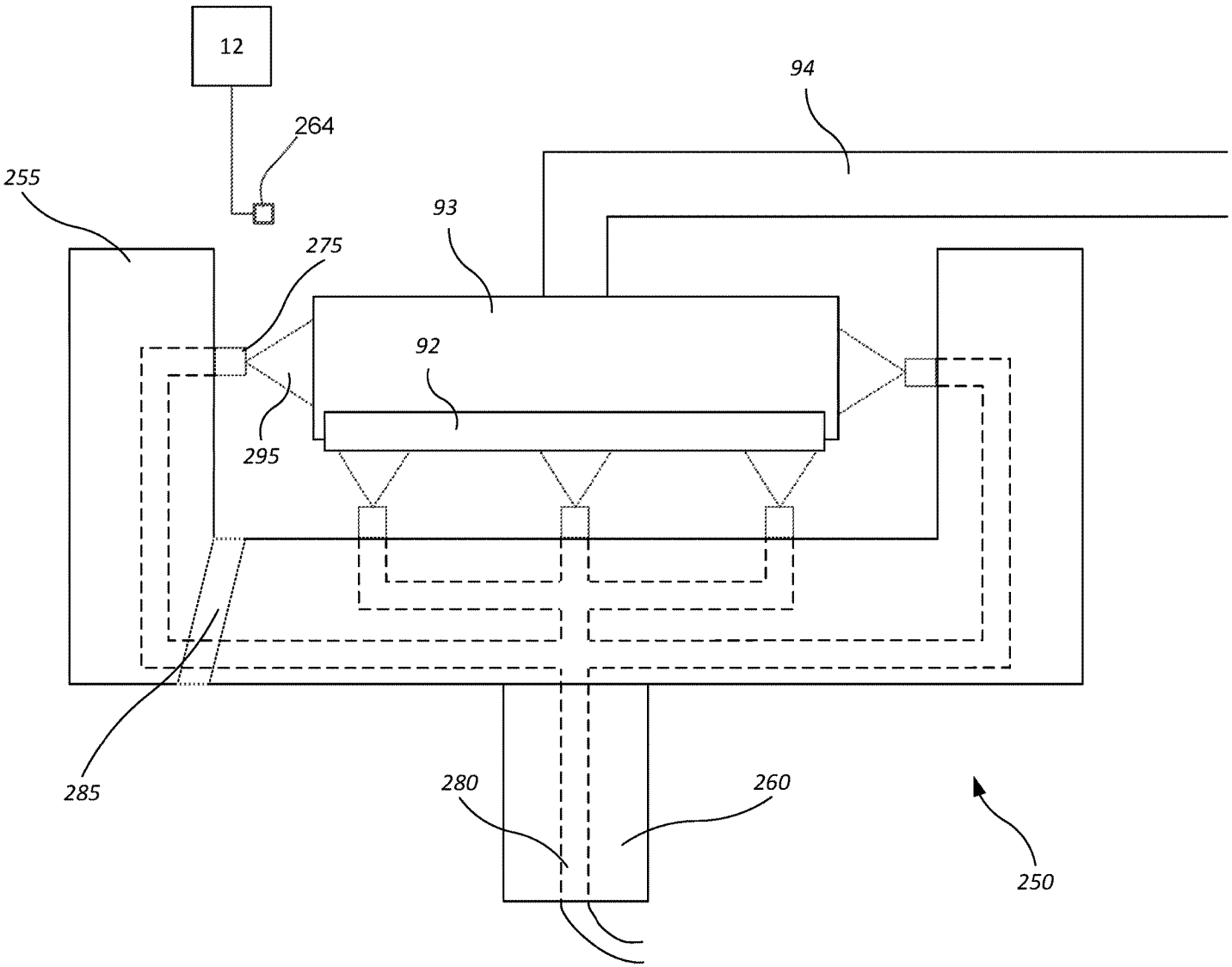
FIG. 3B is a schematic cross-sectional view of an example conditioning head steam treating assembly.

FIG. 3B shows a conditioner steam treating assembly 250 that includes a housing 255. The housing 255 can form of a "cup" to receive the conditioner disk 92 and conditioner head 93. Steam is circulated through a supply line 280 in the housing 255 to one or more nozzles 275. The nozzles 275 can spray steam 295 to remove polishing by-product, e.g., debris or slurry particles, left on the conditioner disk 92 and/or conditioner head 93 after each conditioning operation. The nozzles 275 can be located in the housing 255, e.g., on a floor, side wall, or ceiling of an interior of the housing 255. One or more nozzles can be positioned to clean the bottom surface of the pad conditioner disk, and/or the bottom surface, side-walls and/or and top surface of the conditioner head 93. The steam 295 can be generated using the steam generator 410. A drain 285 can permit excess water, cleaning solution, and cleaning by-product to pass through to prevent accumulation in the housing 255.

The conditioner head 93 and conditioner disk 92 can be lowered at least partially into the housing 255 to be steam treated. When the conditioner disk 92 is to be returned to operation, the conditioner head 93 and conditioning disk 92 are lifted out of the housing 255 and positioned on the polishing pad 30 to condition the polishing pad 30. When the conditioning operation is completed, the conditioner head 93 and conditioning disk 92 are lifted off the polishing pad and swung back to the housing cup 255 for the polishing by-product on the conditioner head 93 and conditioner disk 92 to be removed. In some implementations, the housing 255 is vertical actuatable, e.g., is mounted to a vertical drive shaft 260.

The housing 255 is positioned to receive the pad conditioner disk 92 and conditioner head 93. The conditioner disk 92 and conditioner head 93 can rotate within the housing 255, and/or move vertically in the housing 255, to allow the nozzles 275 to steam treat the various surfaces of the conditioning disk 92 and conditioner head 93.

The steam 295 delivered by the nozzles 275 can have an adjustable temperature, pressure, and/or flow rate. In some implementations, the temperature, pressure and/or flow rate can be independently adjustable for each nozzle or between groups of nozzles. This permits variation and thus more effective the cleaning of the conditioner disk 92 or conditioner head 93.

For example, the temperature of the steam 295 can be 90 to 200° C. when the steam 295 is generated (e.g., in the steam generator 410 in FIG. 4A). The temperature of the steam 295 can be between 90 to 150° C. when the steam 295 is dispensed by the nozzles 275, e.g., due to heat loss in transit. In some implementations, steam can be delivered by the nozzles 275 at a temperature of 70-100° C., e.g., 80-90° C. In some implementations, the steam delivered by the nozzles is superheated, i.e., is at a temperature above the boiling point.

The flow rate of the steam 295 can be 1-1000 cc/minute when the steam 295 is delivered by the nozzles 275. In some implementations, the steam is mixed with other gases, e.g., is mixed with normal atmosphere or with $N_2$. Alternatively, the fluid delivered by the nozzles 275 is substantially purely water. In some implementations, the steam 295 delivered by the nozzles 275 is mixed with liquid water, e.g., aerosolized water. For example, liquid water and steam can be combined at a relative flow ratio (e.g., with flow rates in sccm) 1:1 to 1:10. However, if the amount of liquid water is low, e.g., less than 5 wt %, e.g., less than 3 wt %, e.g., less than 1 wt %, then the steam will have superior heat transfer qualities. Thus, in some implementations the steam is dry steam, i.e., does not include water droplets.

In some implementations, a temperature sensor 264 can be installed in or adjacent the housing 255 to detect the temperature of the conditioner head 93 and/or conditioner disk 92. The controller 12 can receive a signal from the temperature sensor 264 to monitor the temperature of the conditioner head 93 or conditioner disk 92, e.g., to detect the temperature of the pad conditioner disk 92. The controller 12 can control delivery of the steam by the assembly 250 based on the temperature measurement from the temperature sensor 264. For example, the controller can receive a target temperature value. If the controller 12 detects that the temperature measurement exceeds a target value, the controller 12 halt the flow of steam. As another example, the controller 12 can reduce the steam delivery flow rate and/or reduce the steam temperature, e.g., to prevent overheating of the components during cleaning and/or preheating.

In some implementations, the controller 12 uses a timer. In this case, the controller 12 can start the time when delivery of steam begins, and halt delivery of steam upon expiration of the timer. The timer can be set based on empirical testing to attain a desired temperature of the conditioner disk 92 during cleaning and/or preheating, e.g., to prevent overheating.

Returning to FIG. 2A, in some implementations, the polishing station 20 includes a temperature sensor 64 to monitor a temperature in the polishing station or a component of/in the polishing station, e.g., the temperature of the polishing pad 30 and/or slurry 38 on the polishing pad. For example, the temperature sensor 64 could be an infrared (IR) sensor, e.g., an IR camera, positioned above the polishing pad 30 and configured to measure the temperature of the polishing pad 30 and/or slurry 38 on the polishing pad. In particular, the temperature sensor 64 can be configured to measure the temperature at multiple points along the radius of the polishing pad 30 in order to generate a radial temperature profile. For example, the IR camera can have a field of view that spans the radius of the polishing pad 30.

In some implementations, the temperature sensor is a contact sensor rather than a non-contact sensor. For example, the temperature sensor 64 can be thermocouple or IR thermometer positioned on or in the platen 24. In addition, the temperature sensor 64 can be in direct contact with the polishing pad.

In some implementations, multiple temperature sensors could be spaced at different radial positions across the polishing pad 30 in order to provide the temperature at multiple points along the radius of the polishing pad 30. This technique could be use in the alternative or in addition to an IR camera.

Although illustrated in FIG. 2A as positioned to monitor the temperature of the polishing pad 30 and/or slurry 38 on the pad 30, the temperature sensor 64 could be positioned inside the carrier head 70 to measure the temperature of the substrate 10. The temperature sensor 64 can be in direct contact (i.e., a contacting sensor) with the semiconductor wafer of the substrate 10. In some implementations, multiple temperature sensors are included in the polishing station 22, e.g., to measure temperatures of different components of/in the polishing station.

The polishing system 20 also includes a temperature control system 100 to control the temperature of the polishing pad 30 and/or slurry 38 on the polishing pad. The temperature control system 100 can include a cooling system 102 and/or a heating system 104. At least one, and in some implementations both, of the cooling system 102 and heating system 104 operate by delivering a temperature-controlled medium, e.g., a liquid, vapor or spray, onto the polishing surface 36 of the polishing pad 30 (or onto a polishing liquid that is already present on the polishing pad).

For the cooling system 102, the cooling medium can be a gas, e.g., air, or a liquid, e.g., water. The medium can be at room temperature or chilled below room temperature, e.g., at 5-15° C. In some implementations, the cooling system 102 uses a spray of air and liquid, e.g., an aerosolized spray of liquid, e.g., water. In particular, the cooling system can have nozzles that generate an aerosolized spray of water that is chilled below room temperature. In some implementations, solid material can be mixed with the gas and/or liquid. The solid material can be a chilled material, e.g., ice, or a material that absorbs heat, e.g., by chemical reaction, when dissolved in water.

The cooling medium can be delivered by flowing through one or more apertures, e.g., holes or slots, optionally formed in nozzles, in a coolant delivery arm. The apertures can be provided by a manifold that is connected to a coolant source.

Referring to FIGS. 3A and 3B, an example cooling system 102 includes an arm 110 that extends over the platen 24 and polishing pad 30 from an edge of the polishing pad to or at least near (e.g., within 5% of the total radius of the polishing pad) the center of polishing pad 30. The arm 110 can be supported by a base 112, and the base 112 can be supported on the same frame 40 as the platen 24. The base 112 can include one or more an actuators, e.g., a linear actuator to raise or lower the arm 110, and/or a rotational actuator to swing the arm 110 laterally over the platen 24. The arm 110 is positioned to avoid colliding with other hardware components such as the polishing head 70, pad conditioning disk 92, and the slurry dispensing arm 39.

The example cooling system 102 includes multiple nozzles 120 suspended from the arm 110. Each nozzle 120 is configured to spray a liquid coolant medium, e.g., water, onto the polishing pad 30. The arm 110 can be supported by a base 112 so that the nozzles 120 are separated from the polishing pad 30 by a gap.

Each nozzle 120 can be configured to direct aerosolized water in a spray 122 toward the polishing pad 30. The cooling system 102 can include a source 130 of liquid coolant medium and a gas source 132 (see FIG. 2B). Liquid from the source 130 and gas from the source 132 can be mixed in a mixing chamber, e.g., in or on the arm 110, before being directed through the nozzle 120 to form the spray 122. Alternatively, the liquid from the source can be injected into the gas stream in the nozzle 120.

In some implementations, a process parameter, e.g., flow rate, pressure, temperature, and/or mixing ratio of liquid to gas, can be independently controlled for each nozzle. For example, the coolant for each nozzle 120 can flow through an independently controllable chiller to independently control the temperature of the spray. As another example, a separate pair of pumps, one for the gas and one for the liquid, can be connected to each nozzle such that the flow rate, pressure and mixing ratio of the gas and liquid can be independently controlled for each nozzle.

The various nozzles can spray onto different radial zones on the polishing pad 30. Adjacent radial zones can overlap. In some implementations, the nozzles 120 generate a spray impinges the polishing pad 30 along an elongated region 128. For example, the nozzle can be configured to generate a spray in a generally planar triangular volume.

One or more of the elongated region 128, e.g., all of the elongated regions 128, can have a longitudinal axis parallel to the radius that extends through the region 128 (see region 128*a*). Alternatively, the nozzles 120 generate a conical spray. The sprays 122 from adjacent nozzles 120 can be overlapping, or the nozzles 120 can be oriented so that the elongated regions do not overlap. For example, at least some nozzles 120, e.g., all of the nozzles 120, can be oriented so that the elongated region 128 is at an oblique angle relative to the radius that passes through the elongated region (see region 128*b*).

At least some nozzles 120 can be oriented so that a central axis of the spray (see arrow D) from that nozzle is at an oblique angle relative to the polishing surface 36. In particular, spray 122 can be directed from a nozzle 120 to have a horizontal component in a direction opposite to the direction of motion of polishing pad 30 (see arrow E) in the region of impingement caused by rotation of the platen 24.

Although FIG. 2B illustrates the nozzles 120 as spaced at uniform intervals, this is not required. The nozzles 120 could be distributed non-uniformly either radially, or angularly, or both. For example, the nozzles 120 can clustered more densely along the radial direction toward the edge of the polishing pad 30. In addition, although FIG. 2B illustrates nine nozzles, there could be a larger or smaller number of nozzles, e.g., three to twenty nozzles.

Referring to FIGS. 2A and 2B, for the heating system 104, the heating medium can include steam (e.g., from the steam generator 410, see FIG. 4A). The heating medium can optionally also include other gas, e.g., nitrogen or air, or liquid droplets, e.g., heated water. However, in some implementations the heating medium consists of water; this can be advantageous due to the high heat capacity of water. The medium is above room temperature, e.g., at 40-120° C., e.g., at 90-110° C.

In some implementations, the heating medium is substantially pure de-ionized water. However, for some implementations the steam can include additives or chemicals. The steam can be delivered by flowing through apertures, e.g., holes or slots, in a delivery arm, onto the polishing pad 30.

The flow rate of the heating medium onto the polishing pad 30 can be such that condensation onto the polishing pad is 0.07-0.4 L/min of water. In some implementations, the steam is mixed with other gases, e.g., is mixed with normal atmosphere or with $N_2$. Alternatively, the medium delivered by the openings 144 is substantially purely water. In some implementations, the steam delivered by the openings 144 is mixed with liquid water, e.g., aerosolized water. If the amount of liquid water is low, e.g., less than 5 wt %, e.g., less than 3 wt %, e.g., less than 1 wt %, then the steam will have superior heat transfer qualities. Thus, in some implementations the steam is dry steam, i.e., is substantially free of water droplets. In general, liquid water would not be deliberately introduced into the flow of the steam, but some amount of water droplets may be present, e.g., due to condensation from cooling during transit from the steam generator 410 or due to boiling of the water in the steam generator generating droplets.

An example heating system 104 includes an arm 140 that extends over the platen 24 and polishing pad 30 from an edge of the polishing pad to or at least near (e.g., within 5% of the total radius of the polishing pad) the center of polishing pad 30. The arm 140 can be supported by a base 142, and the base 142 can be supported on the same frame 40 as the platen 24. The base 142 can include one or more actuators, e.g., a linear actuator to raise or lower the arm 140, and/or a rotational actuator to swing the arm 140 laterally over the platen 24. The arm 140 is positioned to avoid colliding with other hardware components such as the polishing head 70, pad conditioning disk 92, and the slurry dispensing arm 39.

Along the direction of rotation of the platen 24, the arm 140 of the heating system 104 can be positioned between the arm 110 of the cooling system 110 and the carrier head 70. Along the direction rotation of the platen 24, the arm 140 of the heating system 104 can be positioned between the arm 110 of the cooling system 110 and the slurry delivery arm 39. For example, the arm 110 of the cooling system 110, the arm 140 of the heating system 104, the slurry delivery arm 39 and the carrier head 70 can be positioned in that order along the direction rotation of the platen 24.

Multiple openings 144 are formed in the bottom surface of the arm 140. Each opening 144 is configured to direct a gas or vapor, e.g., the steam, onto the polishing pad 30. The openings 144 can extend through a plate 145 that forms the floor of the arm 140 from a common manifold 146 inside the arm 140 that is connected to a source of the heating medium, e.g. the steam generator 410. The arm 140 can be supported by a base 142 so that the openings 144 face the polishing pad 30 and are separated from the polishing pad 30 by a gap G. The gap G can be 0.5 to 5 mm. In particular, the gap can be selected such that the heat of the heating fluid does not significantly dissipate before the fluid reaches the polishing pad 30. For example, the gap can be selected such that steam emitted from the openings 144 does not condense before reaching the polishing pad.

The heating system 104 can include a source 148 of steam, e.g., the steam generator 410 (scc FIG. 4A), which can be connected to the arm 140 by tubing 150.

As shown in FIG. 1, in some implementations there is a separate steam generator 410 for each polishing station 20. This permits each individual steam generator 410 to be constructed with a lower volume capacity, as compared to having a common steam generator that provides steam to all of the polishing stations 20. In addition, this permits each steam generator to be operated on a individual control algorithm, thus permitting optimization of power usage versus steam generation for the particular station. So steam can be generated at lower power, or more reliably reach a desired pressure. However, in some implementations the polishing system uses a common steam generator that provides steam to all of the polishing stations 20.

Returning to FIGS. 2A and 2B, in some implementations, the openings 144 from the manifold 146 to the environment are "dumb"—they are machined apertures of predetermined size (set by the machining) and with no valves to individually control the flow rates through the openings. However, in some implementations the arm can include valves so that a process parameter, e.g., flow rate, pressure, and/or mixing ratio of liquid to gas, can be individually controlled for each nozzle.

The various openings 144 can direct steam in a spray 152 onto different radial zones 154 on the polishing pad 30. Adjacent radial zones 154 can overlap. The central axis of the spray 152 from the openings 144 can be normal to the polishing surface 36. Optionally, one or more of the openings 144 can be oriented so that a central axis of the spray from that opening is at an oblique angle relative to the polishing surface 36. Steam can be directed from one or more of the openings 144 to have a horizontal component in a direction opposite to the direction of motion of polishing pad 30 in the region of impingement as caused by rotation of the platen 24.

Although FIGS. 2A and 2B illustrate the openings 144 as spaced at even intervals, this is not required. The openings 144 could be distributed non-uniformly either radially, or angularly, or both. For example, openings 144 could be clustered more densely toward the edge of the polishing pad 30, e.g., to compensate for the larger surface area at the larger radius. As another example, openings 144 could be clustered more densely at a radius corresponding to a radius at which the polishing liquid 39 is delivered to the polishing pad 30 by the slurry delivery arm 39. In addition, although FIG. 2B illustrates nine openings, there could be a larger or smaller number of openings.

The polishing system 20 can also include a high pressure rinse system 106. The high pressure rinse system 106 includes a plurality of nozzles 154, e.g., three to twenty nozzles that direct a cleaning fluid, e.g., water, at high intensity onto the polishing pad 30 to wash the pad 30 and remove used slurry, polishing debris, etc.

As shown in FIG. 2B, an example rinse system 106 includes an arm 160 that extends over the platen 24 and polishing pad 30 from an edge of the polishing pad to or at least near (e.g., within 5% of the total radius of the polishing pad) the center of polishing pad 30. The arm 160 can be supported by a base 162, and the base 162 can be supported on the same frame 40 as the platen 24. The base 162 can include one or more an actuators, e.g., a linear actuator to raise or lower the arm 160, and/or a rotational actuator to swing the arm 160 laterally over the platen 24. The arm 160 is positioned to avoid colliding with other hardware components such as the polishing head 70, pad conditioning disk 92, and the slurry dispensing arm 39.

Along the direction of rotation of the platen 24, the arm 160 of the rinse system 106 can be between the arm 110 of the cooling system 110 and the arm 140 of the heating system 140. For example, the arm 110 of the cooling system 110, the arm 160 of the rinse system 106, the arm 140 of the heating system 104, the slurry delivery arm 39 and the carrier head 70 can be positioned in that order along the direction rotation of the platen 24. Alternatively, along the direction of rotation of the platen 24, the arm 140 of the cooling system 104 can be between the arm 160 of the rinse system 106 and the arm 140 of the heating system 140. For example, the arm 160 of the rinse system 106, the arm 110 of the cooling system 110, the arm 140 of the heating system 104, the slurry delivery arm 39 and the carrier head 70 can be positioned in that order along the direction rotation of the platen 24.

Although FIG. 2B illustrate the nozzles 164 as spaced at even intervals, this is not required. In addition, although FIGS. 2A and 2B illustrate nine nozzles, there could be a larger or smaller number of nozzles, e.g., three to twenty nozzles.

The polishing system 2 can also include the controller 12 to control operation of various components, e.g., the temperature control system 100. The controller 12 is configured to receive the temperature measurements from the temperature sensor 64 for each radial zone of the polishing pad. The controller 12 can compare the measured temperature profile to a desired temperature profile, and generate a feedback signal to a control mechanism (e.g., actuator, power source, pump, valve, etc.) for each nozzle or opening. The feedback signal is calculated by the controller 12 e.g., based on an internal feedback algorithm, to cause the control mechanism to adjust the amount of cooling or heating such that the polishing pad and/or slurry reaches (or at least moves closer to) the desired temperature profile.

In some implementations, the polishing system 20 includes a wiper blade or body 170 to evenly distribute the polishing liquid 38 across the polishing pad 30. Along the direction of rotation of the platen 24, the wiper blade 170 can be between the slurry delivery arm 39 and the carrier head 70.

FIG. 2B illustrates separate arms for each subsystem, e.g., the heating system 102, cooling system 104 and rinse system 106, various subsystems can be included in a single assembly supported by a common arm. For example, an assembly can include a cooling module, a rinse module, a heating module, a slurry delivery module, and optionally a wiper module. Each module can include a body, e.g., an arcuate body, that can be secured to a common mounting plate, and the common mounting plate can be secured at the end of an arm so that the assembly is positioned over the polishing pad 30. Various fluid delivery components, e.g., tubing, passages, etc., can extend inside each body. In some implementations, the modules are separately detachable from the mounting plate. Each module can have similar components to carry out the functions of the arm of the associated system described above.

Referring to FIG. 4A, steam for the processes described in this description, or for other uses in a chemical mechanical polishing system, can be generated using a steam generator 410. An exemplary steam generator 410 can include a canister 420 that encloses an interior volume 425. The walls of the canister 420 can be made of a thermally insulating material with a very low level of mineral contaminants, e.g., quartz. Alternatively, the walls of the canister could be formed of another material, e.g., and an interior surface of the canister could be coated with polytetrafluoroethylene (PTFE) or another plastic. In some implementations, the canister 420 can be 10-20 inches long, and 1-5 inches wide. Volume for a canister can be 1 to 3 liters, e.g., 1 to 1.5 liters if there is a separate steam generator for each station, or 2 to 3 liters if there is a common steam generator for all stations.

Figure 4B:
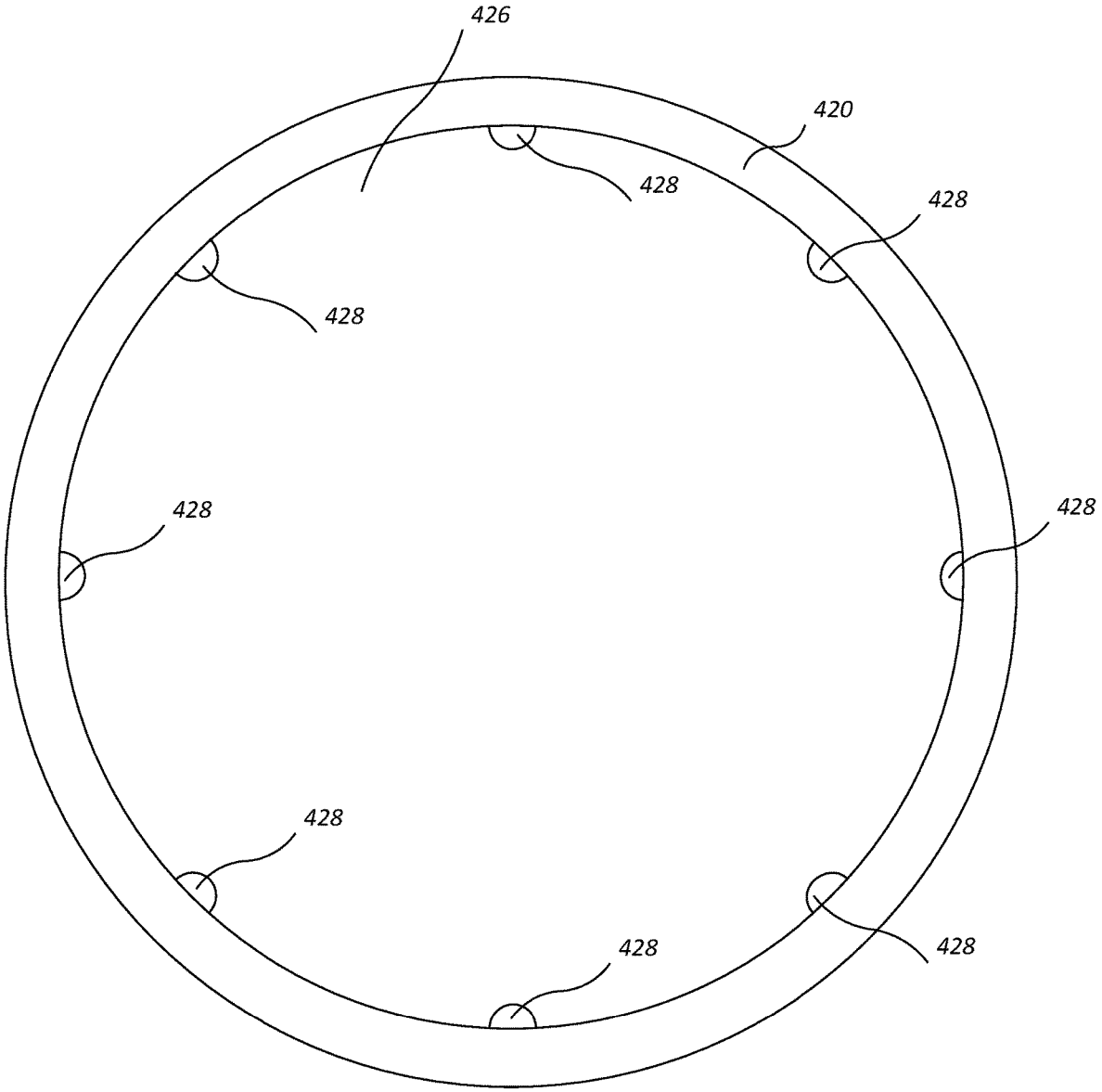
FIG. 4B is a schematic cross-sectional top view of a barrier in a canister in an example steam generator.

Referring to FIGS. 4A and 4B, in some embodiments, the interior volume 425 of the canister 420 is divided into a lower chamber 422 and an upper chamber 424 by a barrier 426. The barrier 426 can be made of the same material as the canister walls, e.g., quartz, stainless steel, aluminum, or a ceramic such as alumina. Quartz may be superior in terms of lower risk of contamination. The barrier 426 can substantially prevent the liquid water 440 from entering the upper chamber 424 by blocking water droplets splattered by the boiling water. This permits the dry steam to accumulate in the upper chamber 424.

The barrier 426 includes one or more apertures 428. The apertures 428 permit the steam to pass from the lower chamber 422 into the upper chamber 424. The apertures 428—and particularly the apertures 428 near the edge of the barrier 426—can allow for condensate on the walls of the upper chamber 424 to drip down into the lower chamber 422 to reduce the liquid content in the upper chamber 426 and permit the liquid to be reheated with the water 440.

The apertures 428 can be located at the edges, e.g., only at the edges, of the barrier 426 where the barrier 426 meets the inner walls of the canister 420. The apertures 428 can be located near the edges of the barrier 426, e.g., between the edge of the barrier 426 and the center of the barrier 426. This configuration can be advantageous in that the barrier 426 lacks apertures in the center and thus has reduced risk of liquid water droplets entering the upper chamber, while still permitting condensate on the side walls of the upper chamber 424 to flow out of the upper chamber.

However, in some implementations, apertures are also positioned away from the edges, e.g., across the width of the barrier 426, e.g., uniformly spaced across the area of the barrier 425.

Referring to FIG. 4A, a water inlet 432 can connect a water reservoir 434 to the lower chamber 422 of the canister 420. The water inlet 432 can be located at or near the bottom of the canister 420 to provide the lower chamber 422 with water 440.

One or more heating elements 430 can surround a portion of the lower chamber 422 of the canister 420. The heating element 430, for example, can be a heating coil, e.g., a resistive heater, wrapped around the outside of the canister 420. The heating element can also be provided by a thin film coating on the material of the side walls of the canister; if current is applied then this thin film coating can serve as a heating element.

The heating element 430 can also be located within the lower chamber 422 of the canister 420. For example, the heating element can be coated with a material that will prevent contaminants, e.g., metal contaminants, from the heating element from migrating into the steam.

The heating element 430 can apply heat to a bottom portion of the canister 420 up to a minimum water level 443*a*. That is, the heating element 430 can cover portions of the canister 420 that is below the minimum water level 443*a* to prevent overheating, and to reduce unnecessary energy expenditures.

A steam outlet 436 can connect the upper chamber 424 to a steam delivery passage 438. The steam delivery passage 438 can be located at the top or near the top of the canister 420, e.g., in the ceiling of the canister 420, to allow steam to pass from the canister 420 into the steam delivery passage 438, and to the various components of the CMP apparatus. The steam delivery passage 438 can be used to funnel steam towards various areas of the chemical mechanical polishing apparatus, e.g., for steam cleaning and preheating of the carrier head 70, substrate 10, and pad conditioner disk 92.

Referring to FIG. 4A, in some embodiments, a filter 470 is coupled to the steam outlet 438 configured to reduce contaminants in the steam 446. The filter 470 can be an ion-exchange filter.

Water 440 can flow from the water reservoir 434 through the water inlet 432 and into the lower chamber 422. The water 440 can fill the canister 420 at least up to a water level 442 that is above the heating element 430 and below the barrier 426. As the water 440 is heated, gas media 446 is generated and rises through the apertures 428 of the barrier 426. The apertures 428 permit steam to rise and simultaneously permit condensation to fall through, resulting in a gas media 446 in which the water is steam that is substantially free of liquid (e.g., does not have liquid water droplets suspended in the steam).

In some embodiments, the water level is determined using a water level sensor 460 measuring the water level 442 in a bypass tube 444. The bypass tube connects the water reservoir 434 to the steam delivery passage 438 in parallel with the canister 420. The water level sensor 460 can indicate where the water level 442 is within the bypass tube 444, and accordingly, the canister 420. For example, the water level sensor 444 and the canister 420 are equally pressured (e.g., both receive water from the same water reservoir 434 and both have the same pressure at the top, e.g., both connect to the steam delivery passage 438), so the water level 442 is the same between the water level sensor and the canister 420. In some embodiments, the water level 442 in the water level sensor 444 can otherwise indicate the water level 442 in the canister 420, e.g., the water level 442 in the water level sensor 444 is scaled to indicate the water level 442 in the canister 420.

In operation, the water level 442 in the canister is above a minimum water level 443*a* and below a maximum water level 443*b*. The minimum water level 443*a* is at least above the heating element 430, and the maximum water level 443*b* is sufficiently below the steam outlet 436 and the barrier 426 such that enough space is provided to allow gas media 446, e.g., steam, to accumulate near the top of the canister 420 and still be substantially free of liquid water.

In some embodiments, the controller 12 is coupled to one, two, or all of i) a valve 480 that controls fluid flow into the assembly, e.g., into canister 420 and the bypass tube 444, ii) a valve 482 that controls gas flow out of the assembly, e.g., into the steam delivery passage 438, and/or iii) the water level sensor 460. Using the water level sensor 460, the controller 12 is configured to regulate the flow of water 440 going into the canister 420 and regulate the flow of gas 446 leaving the canister 420 to maintain a water level 442 that is above the minimum water level 443*a* (and above the heating element 430), and below the maximum water level 443*b* (and below the barrier 426, if there is a barrier 426). The controller 12 can also be coupled to a power source 484 for the heating element 430 in order to control the amount of heat delivered to the water 440 in the canister 420.

As mentioned above, a problem that can occur during generation of steam is "bumping," i.e., the water 440 in the canister 420 can form bubbles that can cause the water to splash upwardly, increasing the likelihood of liquid water droplets passing through the outlet 436 or increasing the likelihood of large fluctuations of the pressure of the steam in the steam delivery passage 438. For example, pressure fluctuation of ±10% of the total steam pressure (for a total variance of 20%), with some sudden pressure drops of 15-25% of the total steam pressure, has been observed.

A technique to address this is to introduce surfaces that provide increased nucleation within the canister 430. The increased nucleation can increase the rate of bubble formation (in terms of number of bubbles), which can reduce the average size of the bubbles and thus reduce bumping. An acceptable level of pressure fluctuation is ±5% of the total steam pressure (for a total variance of 10%).

Figure 5:
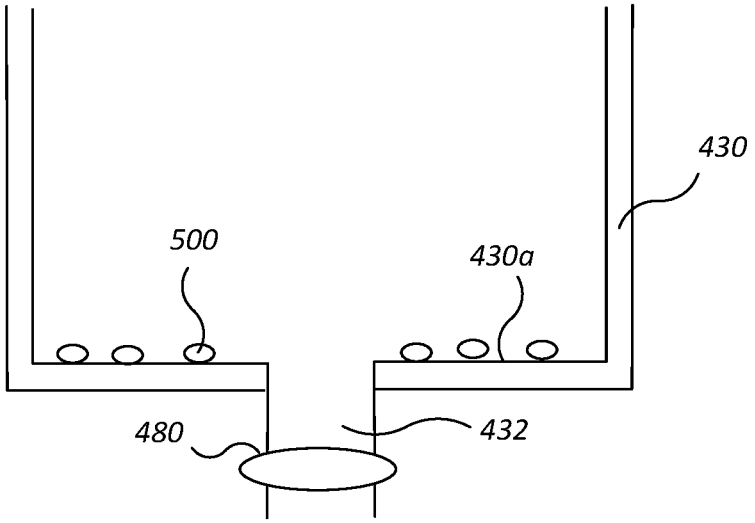
FIG. 5 is a schematic cross-sectional view of a portion of a lower chamber having particulates for nucleation in an example steam generator.

As one example, as shown in FIG. 5, particles 500 can be spread on the floor 430*a* of the canister. The particles can be a material that does not react with the water, e.g., a ceramic, a glass, or a noble metal. The particles 500 could be flakes, beads, etc. The particles could have a width along their maximum dimension of 0.2 to 3 mm. However, a potential danger is that the particles 432 can clog the inlet valve 480, or (particularly for smaller particles) be roiled by the boiling water to be carried by the flow of steam through the outlet 436 to even reach and damage the substrate.

Figure 6:
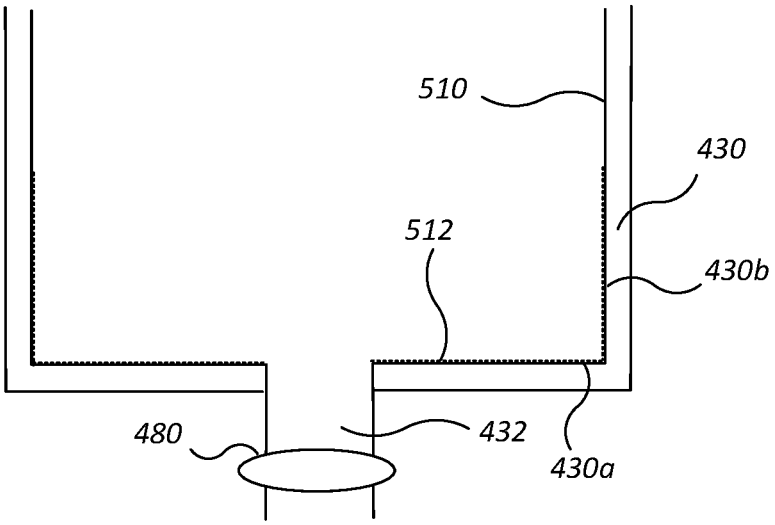
FIG. 6 is a schematic cross-sectional view of a portion of a lower chamber having a roughened inner surface of the canister for nucleation in an example steam generator.

As another example, as shown in FIG. 6, at least a portion 512 of the interior surface 510 of the canister can be treated or manufactured to have increased surface roughness. The portion 512 can have a surface roughness Ra of at least 1 μm, e.g., at least 4 μm, e.g., at least 8 μm. As shown in FIG. 6, the portion can cover all of the floor 430*a* and a part but not all of the sidewall 430*b* of the canister. Alternatively, the portion 512 can cover a part or all of the inner surface of the floor 430*a* of the canister 430, but not the side wall 430*b* of the canners 430*a*. Alternatively, the entire interior surface of the canister 430 can be roughened. Surface roughness can be introduced by etching of the interior surface of the canister 430, by etching the quartz of the canister, e.g., with a hydrofluoric (HF) cleaning solution.

Figure 7:
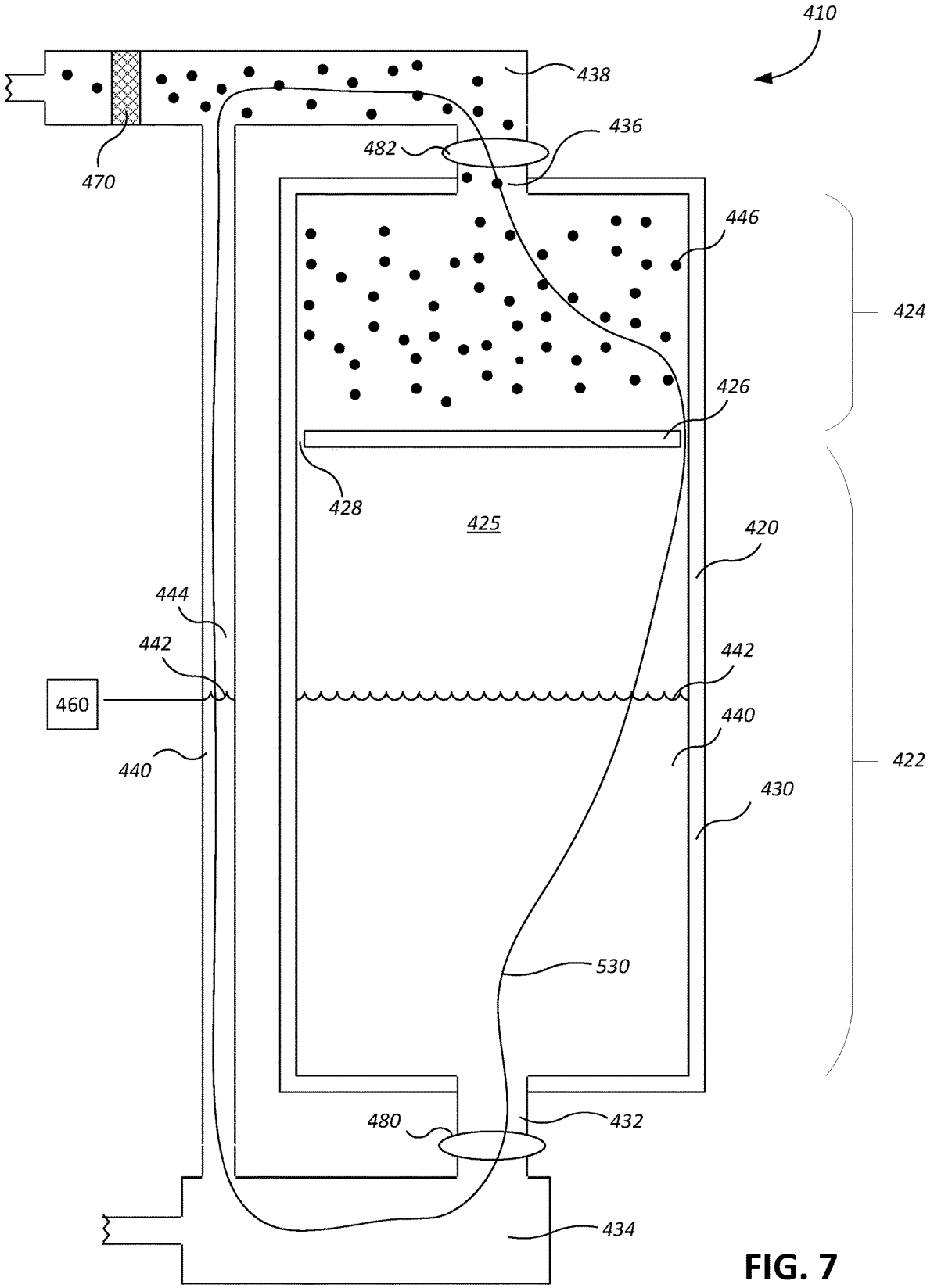
FIG. 7 is a schematic cross-sectional view of an example steam generator having a wire extending in a loop through the canister and passages.

As another example, as shown in FIG. 7, a wire 530 of a metal that does not react with water, e.g., a noble metal, such as platinum or gold, can be placed inside the canister 430. The wire can be gauge of 20 to 40. The wire 530 can provide a nucleation surface for bubbles in the water 440 in the canister 430. Even just a single wire 530 can be sufficient to reduce bumping and pressure fluctuation to an acceptable level.

The wire 530 can be threaded through one of the apertures 428 and the outlet 436. In particular, the wire 430 can extend from the outlet 436 and back downward into the bypass tube 444. In this configuration, the wire 430 can provide a surface onto which liquid water droplets can accumulate and flow back through the bypass tube 444 into the main volume of water 440 in the steam generator 410. This can reduce the liquid water droplet content in the steam output by the steam generator 410, so the steam can be "drier."

In fact, in some implementations, the wire 530 can extend back through the bypass tube 444 to form a loop. This can be accomplished during assembly of the steam generator, e.g., by threading the wire 530 through each part before the piece is secured to the assembly. One end of the wire 530 can be wound around the other end of the wire to form the loop. A potential advantage of the looped wire is that the wire 530 is secured in placed and will not be moved by fluid flow.

In some implementations, the wire is not electrically connected to components outside the canister 430 and passages 434, 438, 444. As the wire is not being used to carry a signal from a sensor, no electrical pass-through or the like is needed.

Referring to FIGS. 1, 2A, 2B, 3A, 3B, and 4A, the controller 12 can monitor the temperature measurements received by the sensors 64, 214, and 264 and control the temperature control system 100, the water inlet 432, and the steam outlet 436. The controller 12 can continuously monitor the temperature measurements and control the temperature in a feedback loop, to tune the temperature of the polishing pad 30, the carrier head 70, and the conditioning disk 92. For example, the controller 12 can receive the temperature of the polishing pad 30 from the sensor 64, and control the water inlet 432 and the steam outlet 436 to control the delivery of steam onto the carrier head 70 and/or conditioner head 92 to raise the temperatures of the carrier head 70 and/or the conditioner head 92 to match the temperature of the polishing pad 30. Reducing the temperature difference can help prevent the carrier head 70 and/or the conditioner head 92 from acting as heat sinks on a relatively higher temperature polishing pad 30, and can improve within-wafer uniformity.

In some embodiments, the controller 12 stores a desired temperature for the polishing pad 30, the carrier head 70, and the conditioner disk 92. The controller 12 can monitor the temperature measurements from the sensors 64, 214, and 264 and control the temperature control system 100, the water inlet 432, and the steam outlet 436 to bring the temperatures of the polishing pad 30, the carrier head 70, and/or the conditioner disk 92 to the desired temperature. By causing the temperatures to achieve a desired temperature, the controller 12 can improve within-wafer uniformity and wafer-to-wafer uniformity.

Alternatively, the controller 12 can raise the temperatures of the carrier head 70 and/or the conditioner head 92 to slightly above the temperature of the polishing pad 30, to allow for the carrier head 70 and/or the conditioner head 92 to cool to the same or substantially the same temperature of the polishing pad 30 as they move from their respective cleaning and pre-heating stations to the polishing pad 30.

A number of embodiments of the invention have been described. Nevertheless, it will be understood that various modifications may be made without departing from the spirit and scope of the invention. Accordingly, other embodiments are within the scope of the following claims.

What is claimed is:

1. A chemical mechanical polishing system, comprising:

a platen to support a polishing pad;

a carrier head to hold a substrate in contact with the polishing pad;

a motor to generate relative motion between the platen and the carrier head;

a steam generator including a canister, a barrier in the canister dividing the canister into a lower chamber having a water inlet and an upper chamber having a steam outlet, wherein the barrier has apertures for steam to pass from the lower chamber to the upper chamber and allows for condensation to pass from the upper chamber to the lower chamber, a heating element configured to apply heat to a portion of lower chamber, and a nucleation surface positioned in the lower chamber; and an arm extending over the platen with at least one opening to deliver steam from the steam generator onto the polishing pad, wherein the nucleation surface comprises a wire, wherein the wire extends through one of the apertures in the barrier, wherein the wire extends through the steam outlet of the canister into a steam delivery passage.

2. The system of claim 1, wherein the wire is a noble metal.

3. The system of claim 2, wherein the wire is platinum.

4. The system of claim 1, wherein the steam generator comprises a bypass tube connecting the water inlet and the steam outlet in parallel with the canister, and wherein the wire extends from the steam delivery passage into the bypass tube.

5. The system of claim 4, wherein the wire extends through the bypass tube and through the water inlet of the canister into the lower chamber of the canister.

6. The system of claim 5, wherein the wire forms a closed loop.

7. The system of claim 1, wherein the wire is not electrically connected to components outside the canister and passages of the steam generator to carry water and steam.

8. The system of claim 1, wherein the water inlet is in a floor of the lower chamber of the canister, and the steam outlet is in a ceiling of the upper chamber of the canister.

9. A steam generator apparatus, comprising:

a canister;

a barrier in the canister dividing the canister into a lower chamber having a water inlet and an upper chamber having a steam outlet, wherein the barrier has apertures for steam to pass from the lower chamber to the upper chamber and allows for condensation to pass from the upper chamber to the lower chamber;

a heating element configured to apply heat to a portion of lower chamber, and a wire that provides a nucleation surface and that extends from the lower chamber through one of the apertures in the barrier into the upper chamber, wherein the wire extends through the steam outlet of the canister into a steam delivery passage, and comprising a bypass tube connecting the water inlet and the steam outlet in parallel with the canister, and wherein the wire extends from the steam delivery passage into the bypass tube.

10. The apparatus of claim 9, wherein the wire extends through the bypass tube and through the water inlet of the canister into the lower chamber of the canister.

11. The apparatus of claim 10, wherein the wire forms a closed loop.

* * * * *